United States Patent [19]

Grosshauser

[11] Patent Number: 4,753,165

[45] Date of Patent: Jun. 28, 1988

[54] SHORT INKING UNIT FOR AN OFFSET ROTARY PRINTING MACHINE

[75] Inventor: Heinrich K. Grosshauser, Wurzburg, Fed. Rep. of Germany

[73] Assignee: Koenig & Bauer Aktiengesellschaft, Würzburg, Fed. Rep. of Germany

[21] Appl. No.: 932,060

[22] Filed: Nov. 18, 1986

[30] Foreign Application Priority Data

Nov. 23, 1985 [DE] Fed. Rep. of Germany ..... 3541458

[51] Int. Cl.[4] ..... B41F 7/24; B41F 31/06

[52] U.S. Cl. ..... 101/148; 101/350

[58] Field of Search ..... 101/148, 147, 350, 363, 101/364, 207, 208–210

[56] References Cited

U.S. PATENT DOCUMENTS 2,676,536 4/1954 Ste-Marie ..... 101/147 X 4,341,156 7/1982 Kaeppner ..... 101/141

FOREIGN PATENT DOCUMENTS 82250 7/1918 Japan ..... 101/148

WO8001151 6/1980 PCT Int'l Appl. ..... 101/148

*Primary Examiner*—J. Reed Fisher

*Attorney, Agent, or Firm*—Jones, Tullar & Cooper, P.C.

[57] ABSTRACT

A short inking unit for an offset rotary printing machine utilizes a heated ink transport cylinder having a particular surface with varying degrees of hydrophilicity, and an array of air blowing nozzles which cooperate to reduce or virtually eliminate contamination of the offset printing ink supply source with dampening fluid. Printing quality is improved since ink viscosity does not change and dampening fluid useage is kept at a minimum.

4 Claims, 2 Drawing Sheets

SHORT INKING UNIT FOR AN OFFSET ROTARY PRINTING MACHINE

FIELD OF THE INVENTION

The present invention is directed generally to a short inking unit for an offset rotary printing machine. More particularly, the present invention is directed to a short inking unit having a heated screened ink transport cylinder and a cooler offset forme cylinder. Most specifically, the present invention is directed to a short inking unit for an offset rotary printing machine having means to maintain a desired ink viscosity. The short inking unit's screened ink transport cylinder is warmed and is subjected to forced air drying. Its screened surface is also treated to provide areas that are more or less hydrophilic. Further, the offset forme cylinder is maintained at a selected temperature which is less than that of the ink transport cylinder. The net result is to provide a short inking unit for an offset rotary printing machine in which the viscosity of the ink is not reduced since little dampening fluid is able to get to the ink supply. Thus undesirable ink and water emulsions are not formed. Furthermore, dampening liquid consumption is kept low.

DESCRIPTION OF THE PRIOR ART

Short inking units, which may be used with offset rotary printing machines, are generally know in the art. These inking units are identified as short inking units because they do not utilize a large number of ink transport cylinders to move the ink from the ink supply means such as an ink fountain or a closed chamber doctor blade to the offset printing plates to which the ink is applied. An example of such a short inking unit may be seen in German published unexamined patent application No. 3,302,872.

Offset rotary printing machines often utilize a dampening fluid such as water. This dampening fluid is supplied to the offset printing plates by a dampening unit with the dampening fluid applied to the plates affecting the ability of selected areas of the offset plates to hold and release printing ink. It typically occurs that a certain portion of this dampening fluid will come into contact with the short offset inking unit and will eventually find its way back to the ink supply source. This has the adverse effect of creating an ink and water emulsion which reduces the viscosity of the ink. A reduction in ink viscosity will, in turn, have a detrimental effect on the quality of the printed product.

If dampening fluid becomes mixed with the ink and is mixed into the ink supply, this volume of dampening fluid is lost to the press and must be added by the dampening unit. Since it is desirable to keep dampening fluid consumption as low as possible, the use of a large amount of dampening fluid is not desirable.

The prior art offset short inking units have not been completely satisfactory and accordingly, there exists a need for a short inking unit which overcomes these shortcomings of the prior devices. The short inking unit for an offset rotary printing machine in accordance with the present invention provides such a device.

SUMMARY OF THE INVENTION

It is an object of the present invention to provide a short inking unit.

Another object of the present invention is to provide a short inking unit for an offset rotary printing machine.

A further object of the present invention is to provide a short inking unit having improved dampening fluid conducting characteristics.

Yet another object of the present invention is to provide a short inking unit having a screened surface ink transport cylinder which utilizes zones that are more or less hydrophilic.

Still a further object of the present invention is to provide a short inking unit including air drying means.

Yet still another object of the present invention is to provide a short inking unit for an offset rotary printing machine which includes maintaining the ink transport cylinder at an elevated temperature.

Even yet a further object of the present invention is to provide a short inking unit for an offset rotary printing machine which includes maintaining the forme cylinder at a reduced temperature with respect to the ink transport cylinder.

As will be discussed in greater detail in the description of the preferred embodiment which is set forth subsequently, the short inking unit for an offset rotary printing machine in accordance with the present invention utilizes a hard screened ink transport roller to transport ink from an ink supply source to one or more rubber covered forme inking rollers. These rubber covered forme inking rollers directly contact offset printing plates carried by a forme cylinder. A dampening unit provides dampening fluid, typically water, to the offset printing plates carried by the forme cylinder.

In accordance with the present invention, the ink transport cylinder is maintained at an elevated temperature while the forme cylinder is kept at a reduced temperature. Further, an air blower is placed adjacent the ink transport cylinder so that air nozzles direct dry air against the surface of the ink transport cylinder. Additionally, the screened ink transport cylinder has a screened peripheral surface which is structured having a plurality of cross pieces whose front or leading surfaces are hydrophilic and whose indentation surfaces are oleophilic. The net result is a marked reduction of dampening fluid being carried back into the ink supply source. This reduction in dampening fluid and ink intermixing reduces the formation of ink emulsions so that the viscosity of the ink is not reduced. Additionally, less dampening fluid is used in the present short inking unit for an offset printing machine than has been the situation with prior art devices.

The short inking unit of the present invention can be seen to improve printing quality by helping to maintain ink viscosity constant. It also reduces operating costs both by reducing the amount of ink wasted due to dampening fluid adulteration and also by reducing dampening fluid consumption. Thus the present invention is a substantial advance in the art.

BRIEF DESCRIPTION OF THE DRAWINGS

While the novel features of the short inking unit for an offset rotary printing machine in accordance with the present invention are set forth with particularity in the appended claims, a full and complete understanding of the invention may be had by referring to the detailed description of the preferred embodiment, as is set forth subsequently, and as is illustrated in the accompanying drawing figures in which:

DESCRIPTION OF THE PREFERRED EMBODIMENT

Figure 1:
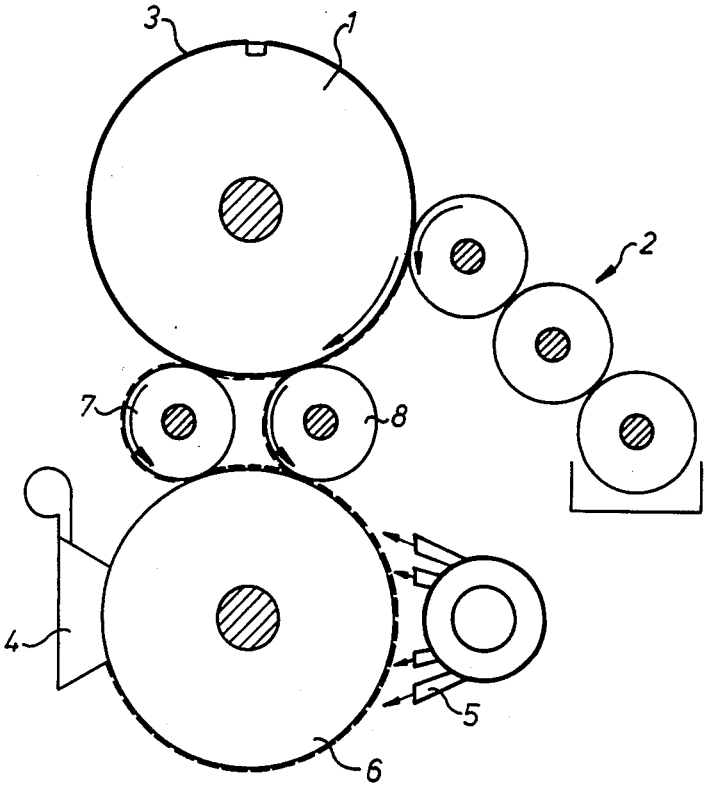
FIG. 1 is a schematic side elevation view of a short inking unit in accordance with the present invention and showing the ink supply means as a chambered doctor blade.

Referring initially to FIG. 1, there may be seen a short inking unit for an offset rotary printing machine in accordance with the present invention. A forme cylinder 1 carries one or more offset printing plates 3 on its periphery. A dampening unit 2 of generally conventional construction supplies a dampening fluid, such as water, to the surface of the offset printing plates 3.

A generally well know chambered doctor blade arrangement, shown generally at 4, serves as an ink sources and supplies offset printing ink to hard ink transport cylinder 6. This ink transport cylinder is of the anilox type and has a screened outer surface that is formed having a plurality of ink receiving indentations or recesses as will be discussed in greater detail shortly. A pair of generally resilient rubber covered forme inking rollers 7 and 8 are placed between ink transport cylinder 6 and forme cylinder 1. These two forme inking rollers 7 and 8 receive the generally well known offset printing ink from the screened ink transport roller 6 and transfer it to the offset printing plate or plates 3.

The screened ink transport cylinder 6 is heated to a temperature generally in the range of 40° and 60° Centigrade and is selectively controlled at a temperature within this range by any suitable control means. In a generally similar fashion, the offset forme cylinder 1 is selectively brought to, and then maintained at a temperature between about 20° and 25° Centigrade. Various generally conventional means may be used to selectively maintain these cylinders at their desired temperatures. Since these devices are old and well know and do not specifically form a part of the subject invention, no further discussion thereof is believed necessary.

As the ink transport cylinder 6 is heated, it then passes heat along to the rubber covered forme inking rollers 7 and 8 by way of the heated ink. These two roller are accordingly warmed to approximately the same temperature as the ink transport cylinder 6. Since the ink transport cylinder 6 is maintained at an elevated temperature and also keeps forme inking rollers 7 and 8 at a similar temperature, superflous dampening fluid that has been supplied to the offset printing plate or plates 3 from the dampening unit 2 and then carried into the ink supply 4 by the returning unused ink and back onto the ink transport cylinder 6, is evaporated. This evaporation of dampening fluid takes place over the entire surface of the ink transport cylinder 6 wherever the ink is on the ink transport cylinder 6 or the forme inking rollers 7 and 8.

A row of air nozzles 5 are placed adjacent the surface of ink transport cylinder 6 and intermediate chamber doctor blade ink supply means 4 and forme inking rollers 7 and 8. These air nozzles 5, which can be arranged parallel to the screened ink transport cylinder 6, will blow dried air against the surface of the heated ink transport cylinder 6. Thus these air nozzles 5 cooperate with the heated ink transport cylinder 6 to further improve evaporation of dampening fluid that is carried by the printing ink as it is carried about the surface of the ink transport cylinder 6.

Figure 2:
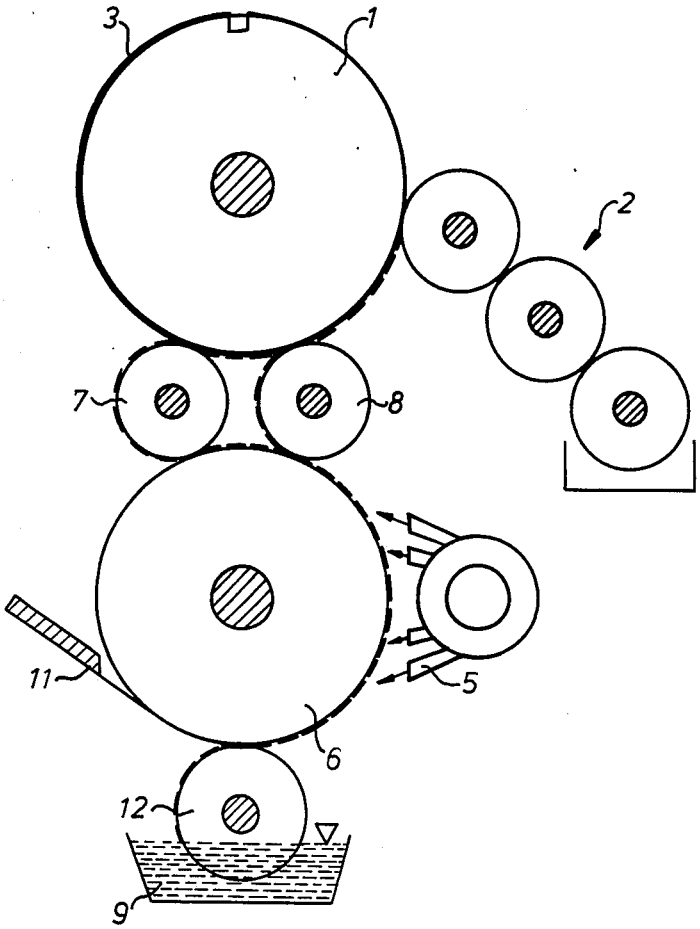
FIG. 2 is a schematic side elevation view generally similar to FIG. 1 and showing the ink supply means as an ink fountain and roller.

Referring now to FIG. 2, there may be seen a short inking unit for an offset rotary printing machine which is generally similar to that shown in FIG. 1. In both of these assemblies similar numerals are used to identify similar elements. As may be seen in FIG. 2, an ink fountain 9 and ink fountain roller 12 replace the chambered doctor blade assembly 4 of FIG. 1 as the ink supply source. Additionally, a doctor blade 11 is engaged with the surface of the ink transport cylinder 6. In this configuration the offset printing ink is supplied from ink fountain 9 and is carried by ink fountain roller 12 to the ink transport cylinder 6. In a manner similar to that described with regards to FIG. 1, the use of the air nozzles 5 and the heated ink transport cylinder 6 serve to evaporate virtually all of the dampening fluid from the ink carried on ink transport cylinder 6. Thus either not dampening fluid or only a very small amount of dampening fluid is able to find its way into the ink supply source whether this source is the chambered doctor blade 4 or the ink fountain 9. Thus the offset printing ink supply in either ink supply source is not water emulsified and does not suffer a substantial loss of viscosity. Accordingly, printing quality is maintained.

Figure 3:
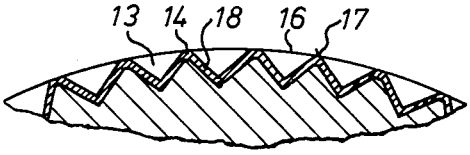
FIG. 3 an enlarged cross-sectional view through a portion of a screened ink transport roller.

Referring now to FIG. 3, the surface of the screened ink transport cylinder 6 may be seen in detail. This surface configuration is also arranged to act as a further means to prevent or reduce the transport of dampening fluid into the offset printing ink source of supply 4 or 9. Ink transport cylinder 6 has a screened surface 16 that is comprised of indentations 13 which are defined by various cross pieces 14. Since the surface of this ink transport cylinder 6 is continually in contact with the chambered doctor blade 4 of FIG. 1 or the doctor blade 11 of FIG. 2, outer or front surfaces 17 of the cross pieces are chrome plated for increased wear resistance. These surfaces are thus also quite hydrophilic. The remaining surface portions 18 of the indentation 13 do not directly contact these wear causing doctor blades. These indentation surfaces 18 are provided with a coating which may be oleophilic or which is at least less hydrophilic than the outer surfaces 17 of the cross pieces 14. A nitrated chrome is a suitable oleophilic coating for the indentation surfaces 18.

Since the outer surfaces 17 of the screened cover 16 of ink transport cylinder 6 are the most hydrophilic, any dampening fluid entrained in the offset printing ink carried by the ink transport cylinder 6 will be apt to be attracted to the outer surfaces 17 of the cross pieces 14. This placement of the dampening fluid enhances its evaporation by increasing air contact as, for example, the ink transport cylinder surface 16 passes the air nozzles 5. Thus this structure of the cross pieces 14 and indentation 13 forms a further means to prevent or limit transport of dampening fluid to the offset printing ink supply source.

The short inking unit for an offset rotary printing machine of the present invention is effective in reducing or virtually eliminating the formation of ink emulsions through the use of an elevated temperature ink transport cylinder 6 having a specific surface configuration and utilizing the air nozzles 5 positioned adjacent the cylinder 6. In this way, very little dampening fluid can find its way to the ink supply source 4 or 9 and thus printing quality is maintained. Furthermore, consumption of dampening fluid is kept at a low level.

While a preferred embodiment of a short inking unit for an offset rotary printing machine has been fully and completely described hereinabove, it will be obvious to one of skill in the art that a number of changes in, for example, the structure of the dampening unit, the specific ink supply source, the number of forme inking rollers, the number of printing plates and the like could be made without departing from the true spirit and scope of the present invention which is accordingly to be limited only by the following claims.

I claim:

1. A short inking unit and offset rotary printing machine comprising:

a screened surface ink transport cylinder, said ink transport cylinder being maintained at selectively elevated temperature;

an offset forme cylinder which carries at least one offset printing plate on its surface and which receives damapening fluid from a dampening unit, said offset forme cylinder being maintained at a selected temperature which is less than said temperature of said ink transport cylinder;

means to transfer offset printing ink to said offset printing plate and including at least one resilient forme inking roller which contacts both said ink transport cylinder and said offset printing plate, said at least one forme inking roller being maintained at generally the same temperature as said ink transport cylinder;

a plurality of dried air blowing nozzles positioned adjacent and generally parallel to said surface of said ink transport cylinder; and offset ink supply means to supply said offset printing ink to said surface of said ink transport cylinder, said dried air blowing nozzles and said elevated temperature screened surface of said ink transport cylinder preventing the transport of significant amounts of dampening fluid to said ink supply means from the damping unit whereby the formation of oil and dampening fluid emulsions is minimized.

2. The short inking unit and offset rotary printing machine of claim 1 wherein said screened surface of said ink transport cylinder includes spaced cross pieces which define indentations therebetween, an outer surface portion of each of said cross pieces being a hydrophilic material and a surface portion of each of said indentations being an oleophilic material.

3. The short inking unit of claim 2 wherein said hydrophilic material is chrome.

4. The short inking unit of claim 3 wherein said oleophilic material is nitrated chrome.

* * * * *